US009744388B2

(12) United States Patent
Ewers et al.

(10) Patent No.: US 9,744,388 B2
(45) Date of Patent: Aug. 29, 2017

(54) COMPRESSED AIR FOAM SYSTEM WITH SIMPLIFIED USER INTERFACE

(75) Inventors: Ronald Lee Ewers, Ocala, FL (US); Bradley Lyle Busch, Ocala, FL (US); Bradley Alan Ewers, Ocala, FL (US)

(73) Assignee: Spartan Motors, Inc., Charlotte, MI (US)

( * ) Notice: Subject to any disclaimer, the term of this patent is extended or adjusted under 35 U.S.C. 154(b) by 513 days.

(21) Appl. No.: 13/216,010

(22) Filed: Aug. 23, 2011

(65) Prior Publication Data

US 2013/0048318 A1 Feb. 28, 2013

(51) Int. Cl.

| | |
|---|---|
| ***A62C 5/02*** | (2006.01) |
| ***A62C 31/12*** | (2006.01) |
| *B01F 5/04* | (2006.01) |

(52) U.S. Cl.

CPC ..... *A62C 5/02* (2013.01); *A62C 31/12* (2013.01); *B01F 5/0406* (2013.01); *Y10S 261/26* (2013.01)

(58) Field of Classification Search

USPC ..... 169/13–15, 24, 44; 239/8, 9, 61, 67–69

See application file for complete search history.

(56) References Cited

U.S. PATENT DOCUMENTS

| | | | | |
|---|---|---|---|---|
| 3,977,474 | A * | 8/1976 | Boegli | 169/9 |
| 4,318,443 | A | 3/1982 | Cummins | |
| 4,981,178 | A | 1/1991 | Bundy | |
| 5,255,747 | A * | 10/1993 | Teske et al. | 169/15 |
| 5,427,181 | A * | 6/1995 | Laskaris et al. | 169/14 |
| 5,803,596 | A | 9/1998 | Stephens | |
| RE36,196 | E * | 4/1999 | Eberhardt | 169/14 |
| 6,155,351 | A | 12/2000 | Breedlove et al. | |
| 6,357,532 | B1 * | 3/2002 | Laskaris et al. | 169/43 |
| 6,733,004 | B2 * | 5/2004 | Crawley | 261/18.1 |

(Continued)

FOREIGN PATENT DOCUMENTS

| | | |
|---|---|---|
| CL | 1615-1999 | 5/2000 |

OTHER PUBLICATIONS

Pneumax PTO-Driven Compressor Kit Installation Guide; date last visited Jun. 22, 2011; 36 pages; Pneumax, Inc., Peoria, Arizona USA; http://www.pneumaxcafs.com/manuals/installation/Old_140_200_SP_install_REV.pdf.

(Continued)

*Primary Examiner* — Alexander Valvis

(74) *Attorney, Agent, or Firm* — Reinhart Boerner Van Deuren P.C.

(57) ABSTRACT

A one-touch Compressed Air Foam System (CAFS) is provided that allows for a simplified user interface and simplified user operation. The user interface allows the CAFS to activate upon a single press of a single button. An electronic controller checks that several CAFS device parameters show that the CAFS is capable of operating. The controller gathers the device parameter data from a diagnostic system present in the CAFS that gives data pertaining to whether water is flowing, whether foam concentrate is present in the system, whether foam is flowing, and whether the temperature of an air compressor is within a safe range for operation. If the above device parameters are found to be in condition for safe operation of the CAFS, the controller will start and maintain operation until either one of the above falls out of tolerance or the user initiates a shut down of the CAFS.

12 Claims, 5 Drawing Sheets

(56) References Cited

U.S. PATENT DOCUMENTS

| | | | | |
|---|---|---|---|---|
| 6,991,041 | B2 * | 1/2006 | Laskaris et al. | 169/14 |
| 7,445,025 | B2 * | 11/2008 | Shafique et al. | 137/614.2 |
| 7,766,537 | B2 * | 8/2010 | Gembala | 366/10 |
| 8,286,719 | B2 * | 10/2012 | Vetesnik | 169/14 |
| 8,307,907 | B2 * | 11/2012 | Laskaris et al. | 169/44 |
| 2004/0177975 | A1 | 9/2004 | Laskaris et al. | |
| 2007/0209807 | A1 * | 9/2007 | Kruger et al. | 169/15 |
| 2010/0236799 | A1 * | 9/2010 | Vetesnik | 169/70 |

OTHER PUBLICATIONS

OneSeven Compressed Air Foam Systems of the 3rd Generation; date last visited Jul. 5, 2011; pages; Gimaex, Jupiter, Florida USA; http://www.gimaex-usa.com/media/downloads/OneSeven-3Generation.pdf.

Intelligent CAF Selector; date last visited Jul. 5, 2011; 2 pages; Elkhart Brass, Elkhart, Indiana USA; http://www.elkhartbrass.com/files/aa/downloads/brochures/UICS-2_Info_Sheet.pdf.

Fire Apparatus & Emergency Equipment; date last visited Jul. 5, 2011; 2 pages; PennWell Corporation; http://www.fireapparatusmagazine.com/index/display/article-display/8407105663/articles/fire-apparatus/Volume-13/issue-09/features/exclusive-caf-system-designed-for-e-one-classic.html.

Odin Darley Autovalve Specifications; date last visited Jul. 5, 2011; 2 pages; Odin Foam Division, W.S. Darley & Company; http://www.odinfoam.com/downloads/products/odin_darley_autovalve_specs.zip.

Hale—FoamLogix 3.3 & 5.0 Foam Proportioning Sytems; date last visited Jul. 5, 2011; 1 page; http://www.haleproducts.com/Main/Products,127,127.aspx.

CAFSPro Midship CAF System; date last visited Jul. 5, 2011; 1 page; Hale Products Inc., a Unit of IDEX Corporation, Conshohocken, Pennsylvania USA; http://www.haleproducts.com/Main/Products,142,142,0.aspx.

CAFSPro Midship CAF System; date last visited Jul. 5, 2011; 1 page; Hale Products Inc.; http://www.haleproducts.com/Main/Products,142,142,0.aspx.

RapidCAFS Mobile Compressed Air Foam System; date last visited Apr. 26, 2011; 2 pages; Reach Engineering.

Crimson Fire Smart Switch CAFS Control; manual; known prior to Aug. 23, 2011; 21 pages; Crimson Fire, a Spartan Company.

* cited by examiner

400

| Over Temp | BV Reg | Air Status | | Balaning Valve |
|---|---|---|---|---|
| | | 1 | 0 | |
| 0 | 0 | 0 | 0 | 0 |
| 0 | 0 | 0 | 1 | 0 |
| 0 | 0 | 0 | 2 | 1 |
| 0 | 0 | 1 | 0 | 0 |
| 0 | 0 | 1 | 1 | 0 |
| 0 | 0 | 1 | 2 | 1 |
| 0 | 0 | 2 | 0 | 1 |
| 0 | 0 | 2 | 1 | 1 |
| 0 | 0 | 2 | 2 | 1 |
| 0 | 1 | X | X | 1 |
| 1 | X | X | X | 0 |

406 402 404

FIG. 4

COMPRESSED AIR FOAM SYSTEM WITH SIMPLIFIED USER INTERFACE

FIELD OF THE INVENTION

This invention generally relates to fire control systems, and more particularly to a fire control system that adds compressed air into a water and foam fire suppressant mixture, commonly known as a Compressed Air Foam System (CAFS).

BACKGROUND OF THE INVENTION

A fire is caused when heat energy is introduced to a fuel along with an oxidation agent. A fire will continue to burn as long as the fuel, oxidation agent, and heat energy are still present in the system.

Historically, the most popular method of extinguishing a fire is with the use of water. Water can extinguish a fire by removing the heat energy from the above listed elements needed for a fire. Specifically, when water is introduced into a fire that is burning a fuel source the water will coat the fuel source such that when the heat energy is introduced to the water saturated fuel source the water will vaporize thereby cooling the system. Additionally, when water is introduced to a fire system the heat energy will vaporize the water, and water vapor will displace the oxygen, which acts as the oxidation agent in a typical fire system. Therefore, when the water is vaporized it asphyxiates the fire.

However, water has been found to be an inefficient way to suppress a fire. A more ideal fire suppressing solution is a foam. Foam is a better fire suppressant than water because it adheres to the fuel source better than water alone does. Because it adheres to the source of fuel for the heat energy better than water, the foam is capable of removing more heat energy by the fact that more foam is present on the fuel source of the system.

In such systems, compressed air is used to help produce the foam. The foam is produced when water is mixed with a foam concentrate, which is aided by the introduction of compressed air. Not only does the compressed air help to mix the foam concentrate and the water but also helps to propel the foam solution when actually being applied to the fire.

Typically, the foam is applied to a fire from a fire truck. The fire truck usually has access to water from a fire hydrant. The fire truck usually has a storage tank for the foam concentrate and an air compressor to compress air for use in creating a foam and applying that foam to the fire. To control this mixing and application, the fire truck is operated by firemen who control the application of the foam in order to best extinguish the fire.

The process of adding compressed air to water and foam concentrate to form the fire extinguishing foam is manually managed by the firemen present during a fire. Creating the compressed air foam mixture requires the firemen managing the situation to monitor the flow of water, the quantity of foam concentrate, whether foam is flowing, and the temperature of the air compressor in order to determine if the system is capable of generating the foam. This is a complicated task considering that it must be done under the high stress situation typically experienced by firemen. Because this task is complicated and must be done under stressful conditions many firemen will not use the current devices on the market.

Therefore, there is a need for a fire control system that monitors the water flow, foam concentrate level, foam flow, and the air compressor temperature that does not require the complete attention of the firemen present at the scene.

Embodiments of the invention provide such a fire control system. These and other advantages of the invention, as well as additional inventive features, will be apparent from the description of the various embodiments of invention provided herein.

BRIEF SUMMARY OF THE INVENTION

In view of the above, embodiments of the present invention provide a new and improved fire control device that overcomes one or more of the problems existing in the art. More particularly, embodiments of the present invention provide a new and improved CAFS fire control device that overcomes one or more of the problems existing in the art. Still more particularly, embodiments of the present invention provide a new and improved CAFS that does not require an individual, in a stressful fire fighting situation, to focus on intricate CAFS device parameters in order to determine whether the CAFS is capable of operating.

In one embodiment, the CAFS device monitors the CAFS device parameters via a diagnostic system that provides data to an electronic controller. The device parameters measured by the diagnostic system are whether water is flowing in the device, whether foam concentrate is present in the device, whether foam is flowing in the device, and whether the air compressor temperature is not too high. The controller runs an CAFS control program that checks the device parameters to ensure that the CAFS is running properly. If one of the above listed device parameters is no longer met during CAFS operation the CAFS control program tells the controller to shut down the CAFS.

In another embodiment, rather than the electronic controller deciding when to deactivate the CAFS a system user can manually control the CAFS via a control interface. The control interface allows the system user to manually deactivate certain functionality of the CAFS. For instance, the system user can configure the CAFS to expel only water, only compressed air, only foam, or only water and compressed air. This way the system user has the option to take over control from the CAFS control program of the various functions performed by the electronic controller.

In yet another embodiment, the CAFS has a simple user interface. The CAFS is activated by a user merely actuating a single button. Upon actuating the single button the electronic controller will check to see if the diagnostic system shows that the CAFS is ready for use, and if it is then the controller will activate the CAFS. Actuating the button a second time will cause the CAFS to shut down.

In yet another embodiment, a fire control device has multiple CAFS subsystems. Each of these subsystems has a user interface. All of the subsystems are controlled by a single controller for the fire control device.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIG. 4 is a truth table showing the operational states of a balancing valve used in one embodiment of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
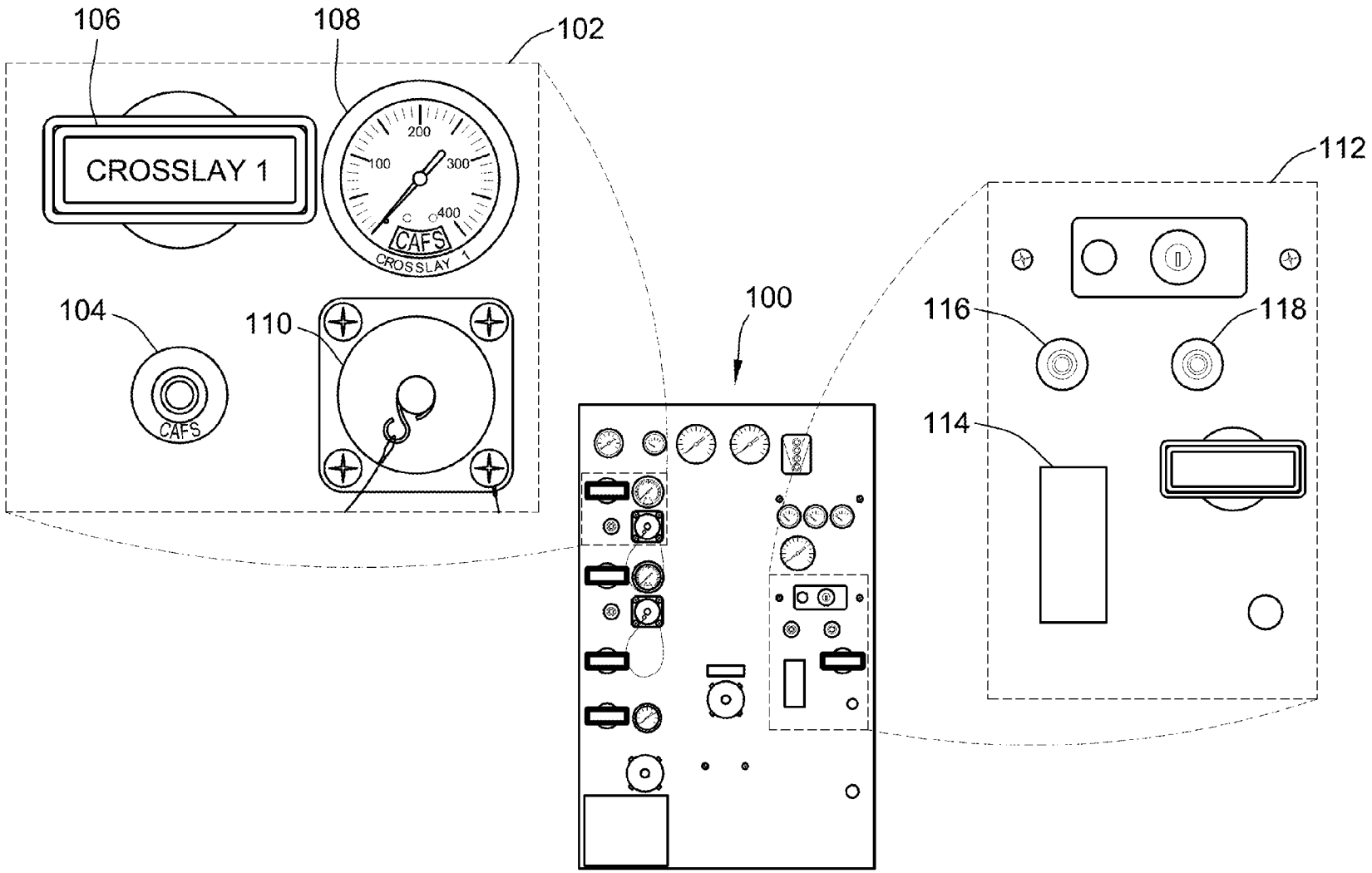
FIG. 1 is a Fire Apparatus Control Panel with an enlarged view of the CAFS user interface and an enlarged view of the active control interface, in accordance with one embodiment.

FIG. 1 is a depiction of a fire control system 100, which contains three subsystems: a water system, a foam system, and a compressed air system. These three systems work together to create a CAFS.

In one embodiment, fire control system 100 has a simplified user interface 102 and an active control interface 112 for the CAFS. The simplified user interface 102 is enlarged to show the simplicity of the design. Interface 102 contains switch or button 104 that both activates and deactivates the CAFS by activating the water, foam, and compressed air subsystems all with the single button 104. Additionally, the interface 102 includes an LED indicator light called an air request indicator 106 that is illuminated when the CAFS is activated, a discharge pressure indicator 108 that displays the pressure of the fluid in a discharge valve (not shown), which is connected to a discharge connector 110.

Furthermore, FIG. 1 shows an enlarged active control interface 112. This interface 112 provides the user with an active control for the CAFS. The active control allows the user to override actions taken by the CAFS after activation via the simplified user interface 102.

Additionally, the active control interface 112 allows the user to activate various subsystems for the fire control system 100 independently from each of the other subsystems. Separate manual control switches are present to activate these subsystems. Specifically, manual control 114 activates the water system such that when this control is actuated the fire control system 100 will discharge water. Manual control 116 activates the foam system such that when this control is actuated the fire control system 100 will discharge foam. Manual control 118 activates the compressed air system such that when this control is actuated the fire control system 100 will discharge compressed air. The water and air subsystems can be activated alone. But activating the foam subsystem requires the water subsystem be activated in addition to the foam subsystem. Note that if all three are activated then this is the same as actuating the single button 104 from interface 102.

Figure 2:
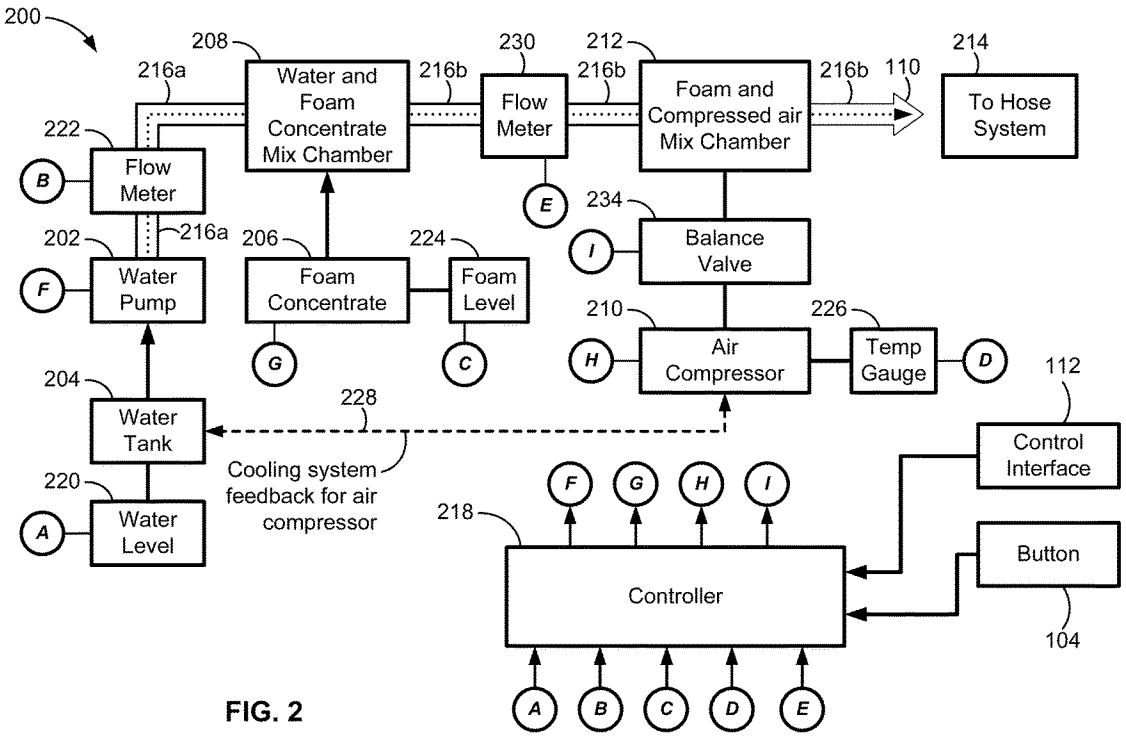
FIG. 2 is a block diagram of an embodiment of a fire control system constructed in accordance with the present invention.

FIG. 2 is a block diagram of one embodiment of the CAFS 200 constructed in accordance with the teachings of the present invention. The one-button CAFS 200 includes a water pump 202, which pumps water from a water tank 204. The water tank 204 is prefilled prior to CAFS 200 use and can be replenished during use by filling from a water source such as a fire hydrant. The water pump pressurizes the water and sends it into the main water manifold 216*a* for the CAFS 200.

The manifold 216*a* feeds the pressurized water into a water and foam concentrate mix chamber 208. Chamber 208 also connects to a foam concentrate supply chamber 206. When the CAFS 200 is activated, foam concentrate from the foam concentrate chamber 206 is mixed with water to produce the foam used for extinguishing a fire.

As an aside, chamber 208 has a pass-through capability, which is activated from active control interface 112 (from FIG. 1). The pass through capability allows the operator of the fire control system 100 to operate in a water only condition by actuating manual control 114. When in this condition, chamber 208 does not allow the foam concentrate to mix with the water thereby disabling the foam concentrate mixing process. When the operator activates the CAFS via interface 102, the foam concentrate mixing process is started.

After the water and foam concentrate are mixed a foam is created, the foam proceeds into a foam and compressed air mixing chamber 212. Chamber 212 is coupled to an air compressor 210. The air compressor 210 injects compressed air into chamber 212 in order to create the compressed air foam mixture.

The pressure of chamber 212 is regulated such that the pressure added by the air compressor 210 does not cause mechanical damage to the CAFS 200. A balancing valve 234 regulates the pressure between the compressed air and the water/foam mixture. Controller 218 actuates the balancing valve 234 in order to regulate the pressure in the system. The balancing valve is only open when the air compressor 210 is active and not overheating.

As an aside, chamber 212 can block the foam from passing out of chamber 212 and into manifold 216*b*. This way the CAFS 200 will eject only compressed air. This functionality is controlled by the system operator actuating manual control 118 on the active control interface 112 (from FIG. 1). Having access to a steady flow of compressed air can be beneficial while fighting fires for operating air tools, filling rescue air bags, etc.

In one embodiment, a liquid cooling system 228 is present to maintain a safe operating temperature for the air compressor 210. The cooling effect is accomplished by passing water through a cooling duct (not pictured) of the air compressor 210 and then returning the water to the water tank 220. By implementing this cooling system the useful period of the air compressor 210 is extended beyond what it would be if no cooling system were present. Therefore, the cooling system allows the firefighters to employ the air compressor 210 for longer periods of time.

Further, the CAFS 200 has specific diagnostic systems to measure device parameters. The device parameters are then provided to the CAFS 200 controller 218. Specifically, the diagnostic system includes a water level monitoring device 220, a flow meter 222, a foam concentrate level monitoring device 224, a flow meter 230, and a temperature gauge 226. The water level monitoring device 220 is used to determine whether the CAFS 200 has adequate reserves of water, in water tank 204, to maintain functionality. The flow meter 222 is used to monitor that water is flowing in manifold 216*a*. The foam concentrate level monitoring device 224 is used to determine whether enough foam concentrate is present to keep producing foam for the CAFS 200. The flow meter 230 is used to monitor that foam is flowing in the foam manifold 216*b*. The temperature gauge 226 monitors the temperature of the air compressor 210.

The controller 218 acquires the data collected by the diagnostic measuring system. Using the collected data, the controller 218 is capable of safely operating the CAFS 200 without further user interaction, beyond the user merely pressing the activation button 104 (from FIG. 1).

Additionally, the controller 218 interfaces with various subsystems of the CAFS. Specifically, the controller 218 controls the water pump 202, the foam concentrate system 206, and the air compressor 210. By controlling the operation of these subsystems the controller 218 can determine when to shut down the CAFS 200 and in what mode the CAFS 200 operates.

Figure 3:
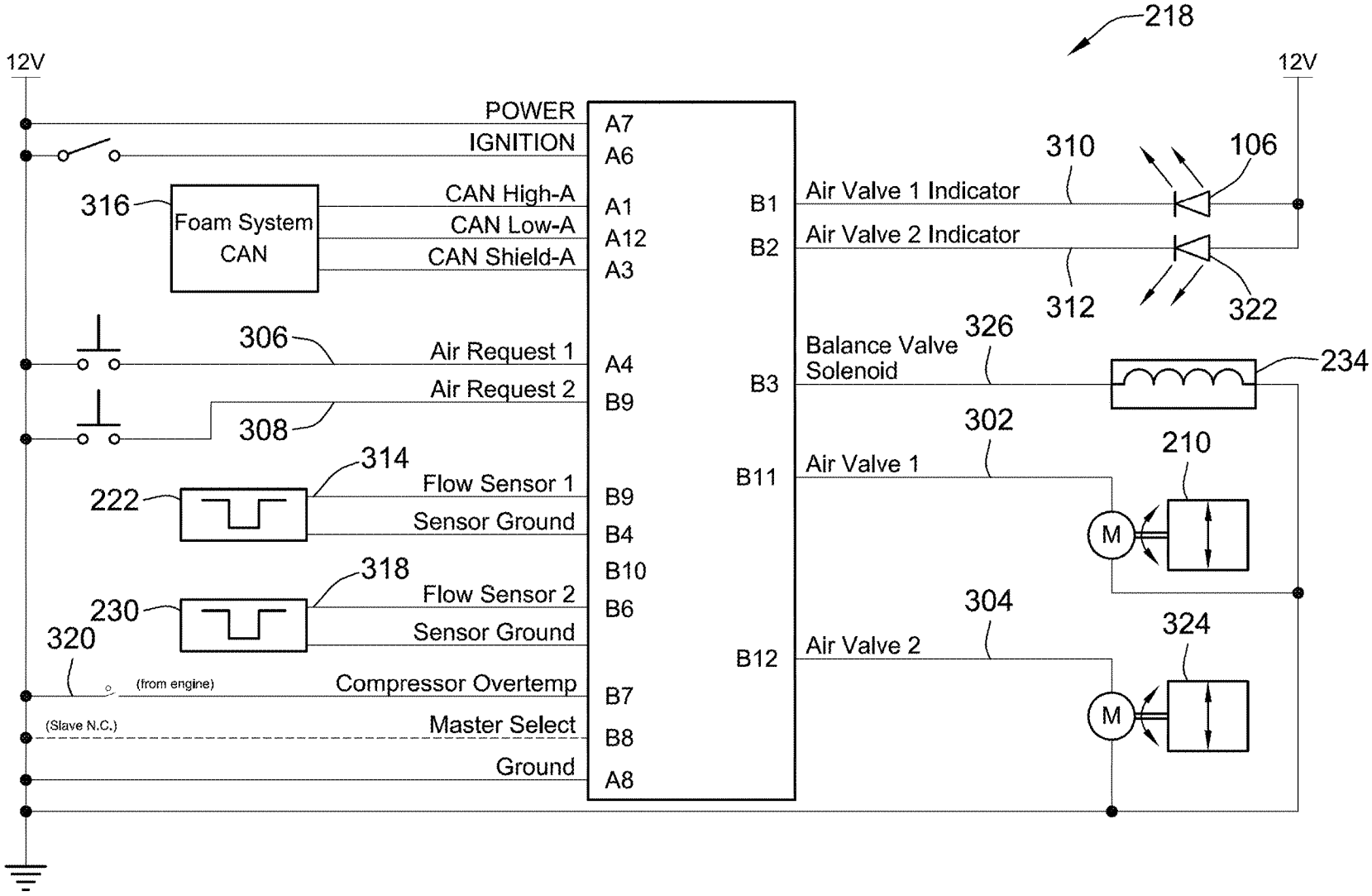
FIG. 3 is a schematic view of an electronic controller for the fire control system used in an embodiment of the present invention.

FIG. 3 shows a schematic view of the controller 218 from FIG. 2. In this embodiment of the invention the controller 218 is configured to control two separate air compressors as indicated by the air valve 1 and air valve 2 output signals 302, 304. Air valve 1 controls air compressor 210 (from FIG. 2) and air valve 2 controls another air compressor (not present in FIG. 2) 324.

Air request 1 306 and air request 2 308 represent two user interfaces one for each of the air valve 1 302 and air valve 2 304. When a user actuates the one button 104 (from FIG. 1) for one of the air request 1 or 2 306, 308 the CAFS may, or may not, result in immediate activation of the air valve 1 or 2 (discussed in detail below); however, an air activation off request, which is accomplished by the user actuating the one button 104 a second time, results in the air valve 1 or 2 302, 304 being closed.

After the user engages either one of the air request 1 or 2 306, 308, the controller 218 will activate the air request indicator 106 (from FIG. 1) or 322 depending on which of the air valve indicator signal 310, 312 was actuated.

The air valve indicator signals 310, 312 show that the CAFS is in one of three separate states, called air request states. The first state is the air request state off. In the air request state off, the air compressor is not running because the user has not pressed the one button 104 in order to turn on the CAFS. The air request indicator 106 (from FIG. 1) or 322 is not illuminated in this state. The second air request state is the pending state. In the pending state, the CAFS runs the control program 500 (from FIG. 5 discussed later) to determine if it is safe to turn on the air compressor 210 or 324. The user will know that the CAFS is in the pending state because the air request indicator 106 or 322 will continuously flash. The third air request state is the on state. In the on state, the air compressor is running. The user will know that the CAFS is in the on state because the air request indicator 106 or 322 will be illuminated and not flashing.

After the user engages either one of the air request 1 or 2 306, 308, thereby causing the CAFS to enter the pending state, controller 218 checks if water is flowing in the system. For proper CAFS operation water must be flowing in the system. Water flow is determined by a signal from the flow meter 222 (from FIG. 2). For water to flow in the system it must either be opened manually via a manual control 114 located on the active control interface 112 (from FIG. 1), or the water flow will be activated once the user actuates the single button 104 from interface 102. Water flow is controlled by actuating a nozzle on the hose module 214 (from FIG. 2), or by actuating the manual control 114 on the active control interface 112.

After the controller 218 verifies that water is flowing in the CAFS, controller 218 checks if foam concentrate is present and that the foam, formed from the mixture of foam concentrate and water, is flowing. The controller 218 is communicatively coupled to the foam concentrate chamber 206, the water and foam mix chamber 208, and the foam concentrate level monitoring device 224 via a Controller-Area Network (CAN) bus 316. The CAN bus 316 allows the controller 218 to regulate when the foam concentrate is released into the water and foam concentrate mix chamber 208 in order to make foam. Additionally, the controller 218 monitors the amount of foam concentrate in the system over the CAN bus 316.

Once a user has activated the CAFS and the controller has already determined that water is flowing, the controller 218 will start the process of mixing foam concentrate with water in the foam concentrate and water mix chamber 208. The controller 218 can tell that foam is flowing by monitoring the flow meter 230 over the flow sensor 2 signal line 318. At this point, the controller will determine if the flow sensor 230 is detecting a constant foam flow for three seconds before it determines that foam is in fact flowing in the system. This is because if the user indicates via the active control interface 112 that they want to use the fire control system 100 in a foam only mode the foam will proceed down a separate manifold (not shown) from manifold 216*b*. The three second verification time is to ensure that a constant stream of foam is present in manifold 216*b* and not just residual foam from a prior use.

After it has been determined that foam is flowing in the system, controller 218 (from FIG. 2) checks if the compressor over-temp input 320 has received a temperature from temperature gauge 226 that is in tolerance for operation of the air compressor 210. If the temperature of the air compressor 210 is within tolerance the controller will activate the air compressor. As an aside, if the fire control system 100 (from FIG. 1) is being operated in a compressed air only mode, as initiated by the user actuating manual control 118, then this is the only function performed by controller 218.

Once the air compressor 210 is activated, the controller 218 can open the balancing valve 234 via its balance valve vent solenoid 326 output, allowing for water pressure to be applied to the balancing valve 234. If the air compressor temperature gauge 226 is indicating a high temperature condition the controller 218 will switch off air compressor 210 and open the balancing valve 234 to vent the air pressure to atmosphere.

FIG. 4 shows truth table 400, which shows the operation of the balancing valve 234 under various CAFS system states. Note that the 0, 1, and 2 in the Air Status 1 and 0 402, 404 column represents the state of the CAFS. A 0 represents the air request state off. A 1 represents the pending state, and a 2 represents the on state. The balancing valve 234 is open when a 2 is present in either column 402 or 404, or the user has initiated a system override check on the balancing valve, as shown in the BV Req column 406.

While controller 218 is shown to only operate two CAFS system in FIG. 3 it is capable of more than two CAFS hardware configurations in the same fire control system 100 (from FIG. 1). Specifically, this means that the same controller 218 is coupled to separate CAFS hardware with its own interface (not shown in FIGs.).

Figure 5:
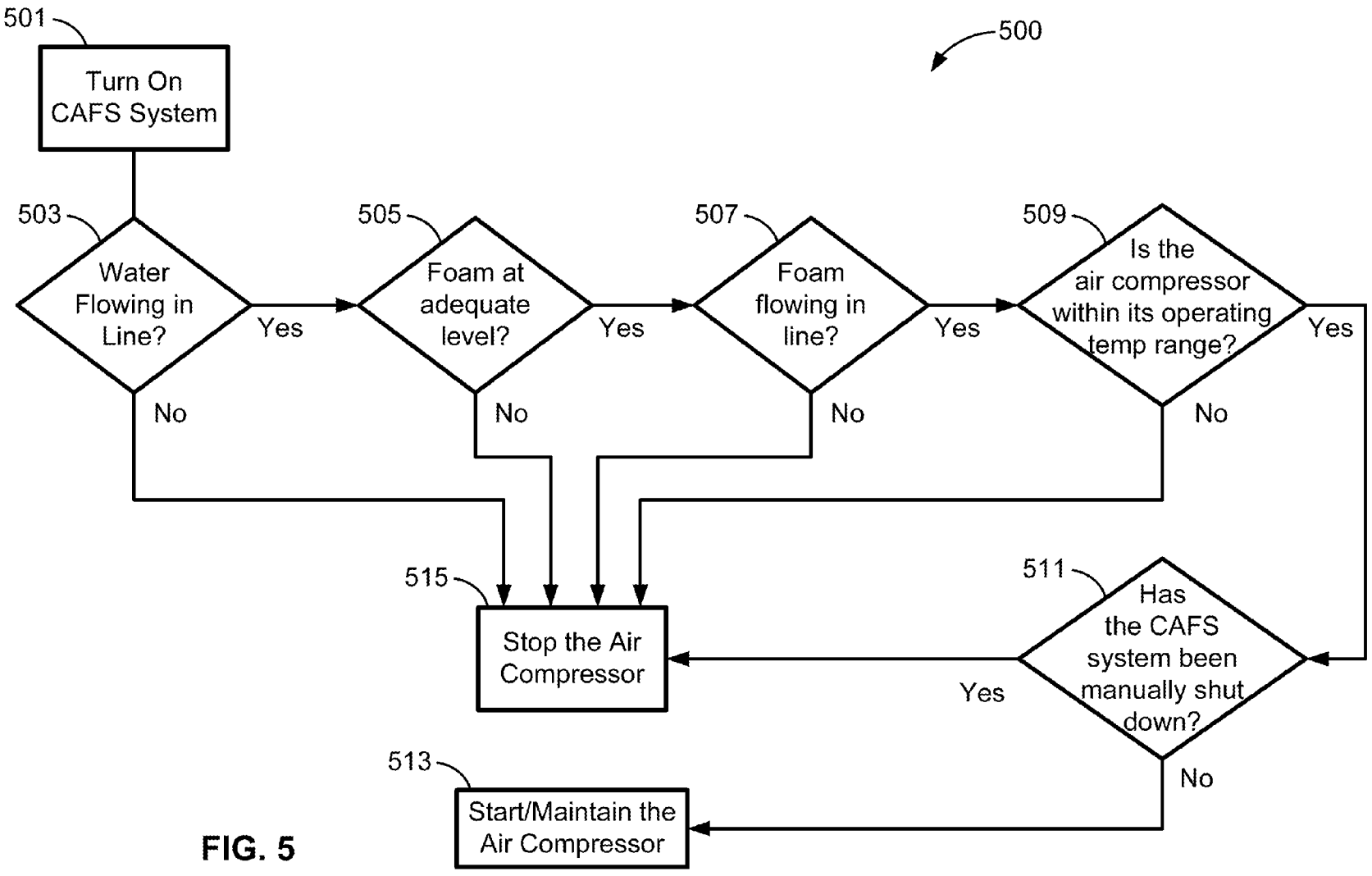
FIG. 5 is a flow chart of the method that the electronic controller performs to decide whether to activate or deactivate the CAFS in accordance with one embodiment of the present invention.

FIG. 5 shows a flow diagram of a CAFS control program 500. Box 501 indicates that a user has initiated the CAFS by pressing button 104 (from FIG. 1). By pressing the button 104 the user has moved the CAFS air request state from the air request state off to the pending state. At this point, the CAFS control program 500 acquires system parameter data from the diagnostic system required to determine whether the air compressor can be activated in order to add compressed air to foam.

First, the CAFS control program 500 determines whether water is flowing in the manifold 216*a* (from FIG. 2) in decision block 503. Prior to this determination, the air request indicator 106 is flashing at a rate of 1 Hz in order to indicate both that the CAFS is in the process of turning on and that water has not yet been shown to be flowing in the CAFS. To determine if water is flowing, data is taken from the water level monitoring device 220 showing that water is present in the water tank 204, and the flow meter 222 is detecting that water is flowing. If the data shows that water is not flowing in the CAFS the CAFS control program 500 proceeds to the stop the air compressor block 515.

Next, if water was found to be flowing in the manifold 216 (from FIG. 2), the air request indicator 106 will begin to flash at a 2 Hz rate, and the CAFS control program 500 checks if the foam concentrate is at an appropriate level in decision block 505. To accomplish this task the foam concentrate monitoring device 224 provides data regarding the level of foam concentrate left in the foam concentrate chamber 206. If there in no foam concentrate in the foam concentrate chamber 206, then the CAFS control program proceeds to the stop the air compressor block 515.

Next, if foam concentrate was found, the CAFS control program 500 checks that foam is flowing in decision block 507. To accomplish this task, the controller 218 (from FIG. 2) takes device data over the foam CAN system 316 (from FIG. 3) to determine that the flow meter 230 is showing that foam is flowing in manifold 216*b*. If flow meter 230 is not showing that foam is flowing, then CAFS control program 500 proceeds to the stop the air compressor block 515.

Next, if the foam is found to be flowing, the CAFS control program 500 checks that the air compressor 210 (from FIG. 2) is not overheating in decision block 509. To accomplish this task the CAFS control program 500 checks the temperature gauge 226 and compares that temperature to a predefined operational threshold temperature for the air compressor 210. If the temperature gauge 226 reads a temperature that is too high for the air compressor 210 to operate safely, the CAFS control program 500 proceeds to the stop CAFS block 515.

Finally, if the temperature of the air compressor 210 (from FIG. 2) is at a safe level, the CAFS control program 500 checks whether the user has initiated a manual shut down of the CAFS, in block 511. The user can initiate a shut down of the CAFS by pressing the one button 104 (from FIG. 1) a second time after initially pressing to start the CAFS. If the user presses button 104 a second time the CAFS control program 500 proceeds to the stop the air compressor block 515. However, if it is found that the user has not manually shut the system down the CAFS control program proceeds to the start/maintain the air compressor block 513.

Once the CAFS control program 500 proceeds to block 513, the CAFS enters the on state, as discussed earlier. At this point the controller 218 (from FIG. 2) continuously runs CAFS control program 500 to determine whether to keep running the air compressor 210 or to shut the air compressor 210 down because one of the decision blocks 503, 505, 507, or 509 resulted in a shut down result. At which point, the CAFS would go back to the second state, the pending state, until CAFS control program 500 shows that the air compressor is safe to turn on again.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A Compressed Air Foam System (CAFS), comprising:
- a water tank;
- a water pump fluidly connected to the water tank;
- a foam concentrate chamber;
- a first mix chamber fluidly connected to the foam concentrate chamber and fluidly connected to the water pump; wherein the water pump injects water from the water tank into the first mix chamber to create a foam;
- a second mix chamber; wherein the first mix chamber is fluidly connected to the second mix chamber;
- an air compressor fluidly connected to the second mix chamber;
  - wherein the foam from the first mix chamber is injected into the second mix chamber and mixed with compressed air from the air compressor;
- a discharge valve fluidly connected to the second mix chamber and configured to discharge a foam and compressed air solution;
- a diagnostic system that takes device parameters from the CAFS; and
- a controller that operates the CAFS based on the device parameters from the diagnostic system.

2. A Compressed Air Foam System (CAFS), comprising:
- a water tank;
- a water pump fluidly connected to the water tank;
- a foam concentrate chamber;

a first mix chamber fluidly connected to the foam concentrate chamber and fluidly connected to the water pump; wherein the water pump injects water from the water tank into the first mix chamber to create a foam;

a second mix chamber; wherein the first mix chamber is fluidly connected to the second mix chamber;

an air compressor fluidly connected to the second mix chamber;

wherein the foam from the first mix chamber is injected into the second mix chamber and mixed with compressed air from the air compressor;

a discharge valve fluidly connected to the second mix chamber and configured to discharge a foam and compressed air solution;

a diagnostic system that takes device parameters from the CAFS; and a controller that operates the CAFS based on the device parameters from the diagnostic system;

wherein the diagnostic system comprises:

a first flow meter fluidly disposed between the water pump and the first mix chamber;

a second flow meter fluidly disposed between the first mix chamber and the second mix chamber;

a foam concentrate monitoring device configured to monitor whether a foam concentrate is present in the foam concentrate chamber; and a temperature sensor configured to monitor the temperature of the air compressor.

3. The CAFS of claim 2, wherein the device parameters collected from the diagnostic system are whether water is flowing, whether an adequate amount of foam concentrate is present, whether foam is flowing, and a temperature of the air compressor.

4. The CAFS of claim 3, wherein the controller will deactivate the air compressor if water is not flowing, or an adequate amount of foam concentrate is not present, or foam is not flowing, or a temperature of the air compressor is too high.

5. The CAFS of claim 2, further comprising a user interface that is communicatively coupled to the controller.

6. A Compressed Air Foam System (CAFS), comprising:

a water tank;

a water pump fluidly connected to the water tank;

a foam concentrate chamber;

a first mix chamber fluidly connected to the foam concentrate chamber and fluidly connected to the water pump; wherein the water pump injects water from the water tank into the first mix chamber to create a foam;

a second mix chamber; wherein the first mix chamber is fluidly connected to the second mix chamber;

an air compressor fluidly connected to the second mix chamber;

wherein the foam from the first mix chamber is injected into the second mix chamber and mixed with compressed air from the air compressor;

a discharge valve fluidly connected to the second mix chamber and configured to discharge a foam and compressed air solution;

a diagnostic system that takes device parameters from the CAFS; and a controller that operates the CAFS based on the device parameters from the diagnostic system;

a user interface that is communicatively coupled to the controller; and, wherein the user interface has a single switch that activates the CAFS upon a first actuation and deactivates the CAFS upon a second actuation.

7. The CAFS of claim 2, further comprising a balancing valve fluidly disposed between the air compressor and the second mix chamber; wherein the controller actuates the balancing valve based on when the air compressor is activated.

8. The CAFS of claim 2, wherein the diagnostic system further comprises a water level monitoring device where the water level monitoring device measures the amount of water in the water tank.

9. The CAFS of claim 2, wherein the water pump also pumps water through a cooling duct of the air compressor.

10. The CAFS of claim 4, wherein the controller is communicatively coupled to a foam generation system that comprises the foam concentrate monitoring device, the foam concentrate chamber, and the first mix chamber via a Controller-Area Network bus.

11. The CAFS of claim 10, further comprising a user interface that is communicatively coupled to the controller and the water pump; wherein the user interface has a first control switch that activates and deactivates the water pump; a second control switch that communicatively coupled to the foam generation system and deactivates the foam generation system; and a third control switch that activates and deactivates the air compressor.

12. The controller of the CAFS of claim 1 further comprising:

an air request input that is configured to activate and deactivate the CAFS based on receiving a signal from the user interface;

an air valve indicator output configured to activate the air request indicator when an activation signal has been received from the user interface; a first flow sensor input configured to receive a signal from the first flow sensor indicating whether water is flowing in the CAFS;

a second flow sensor input configured to receive a signal from the second flow sensor indicating whether foam is flowing in the CAFS;

a Controller-Area Network (CAN) bus configured to control the foam concentrate chamber and the first mix chamber, and receive data from the foam concentrate monitoring device indicating whether foam concentrate is present in the CAFS;

a temperature sensor input configured to receive a signal from the temperature sensor indicating whether the air compressor is overheating;

a balance valve solenoid output configured to control the balancing valve; and an air valve control output configured to activate or deactivate the air compressor.

* * * * *